US006146107A

United States Patent [19]

Kawaguchi et al.

[11] Patent Number: 6,146,107

[45] Date of Patent: Nov. 14, 2000

[54] VARIABLE DISPLACEMENT COMPRESSOR

[75] Inventors: Masahiro Kawaguchi; Tetsuhiko Fukanuma; Kazuaki Iwama; Hiroyuki Nagai, all of Kariya, Japan

[73] Assignee: Kabushiki Kaisha Toyoda Jidoshokki Seisakusho, Kariya, Japan

[21] Appl. No.: 09/148,528

[22] Filed: Sep. 4, 1998

[30] Foreign Application Priority Data

Aug. 9, 1997 [JP] Japan ..... 9-242773

[51] Int. Cl.[7] ..... F04B 1/26

[52] U.S. Cl. ..... 417/222.2; 417/222.1; 92/12.2

[58] Field of Search ..... 92/12.2; 417/222.1, 417/222.2, 269, 218, 219; 917/222.1

[56] References Cited

U.S. PATENT DOCUMENTS

| | | | |
|---|---|---|---|
| 5,304,042 | 4/1994 | Kayukawa et al. | 917/222.1 |
| 5,364,232 | 11/1994 | Kimura et al. | 417/222.1 |
| 5,382,139 | 1/1995 | Kawaguchi et al. | 417/269 |
| 5,387,091 | 2/1995 | Kawaguchi et al. | 417/222.2 |
| 5,417,552 | 5/1995 | Kayukawa et al. | 417/222.2 |
| 5,517,900 | 5/1996 | Kimura et al. | 92/12.2 |
| 5,540,559 | 7/1996 | Kimura et al. | 417/222.2 |
| 5,644,968 | 7/1997 | Kimura et al. | 92/12.2 |
| 5,699,716 | 12/1997 | Ota et al. | 92/12.2 |
| 5,722,310 | 3/1998 | Ota et al. | 92/12.2 |

FOREIGN PATENT DOCUMENTS

| | | | |
|---|---|---|---|
| 195 15 658 C2 | 6/1997 | Germany . | |
| 5172046 | 9/1993 | Japan . | |

*Primary Examiner*—Teresa Walberg
*Assistant Examiner*—Leonid Fastovsky
*Attorney, Agent, or Firm*—Morgan & Finnegan, L.L.P.

[57] ABSTRACT

A drive plate or lug plate is supported on a drive shaft for integral rotation therewith. A cam plate is coupled to the lug plate by a hinge mechanism to integrally rotate with the drive shaft and tilt with respect to the axis of the drive shaft. The cam plate is coupled to a piston to convert the rotation of the drive shaft into linear reciprocating movement of the piston in a cylinder to compress gas supplied from an external circuit and to discharge the compressed gas outward from the cylinder. The hinge mechanism has a first guide pin projecting to the lug plate from the cam plate, a second guide pin projecting to the lug plate from the cam plate in a position following the first guide pin which is the leading pin with respect to the direction of rotation of the drive shalt, a first guide hole formed in a support arm projecting from the lug plate to receive the first guide pin and a second guide hole formed in a second support arm projecting from the drive plate to receive the second guide pin. The first guide hole is located in a position offset from the second guide hole away from the rear surface of the lug plate by a distance which corresponds to the amount of movement of the cam plate and first guide pin caused by compression reaction on the piston during the compression stroke.

25 Claims, 7 Drawing Sheets

VARIABLE DISPLACEMENT COMPRESSOR

The present invention relates to variable displacement compressors that may be employed in vehicle air conditioners.

A typical prior art variable displacement compressor is shown in FIGS. 6, and 9–11. As shown in FIG. 6 of the drawings, a drive shaft 101 is rotatably supported in a housing, which houses a crank chamber. The housing includes a cylinder block, through which a plurality of cylinder bores 102 (e.g., six bores) extend. A piston 103 is accommodated in each cylinder bore 102.

As shown in FIG. 9*a* lug plate 104 and a swash plate 105, which functions as a cam plate, are coupled to the drive shaft 101 in the crank chamber. The lug plate 104 is supported to rotate integrally with the drive shaft 101, and the swash plate 105 is supported to incline relatively to the drive shaft 101. The swash plate 105 has a shaft bore 105*a* through which the drive shaft 101 is inserted. The lug plate 104 and the swash plate 105 are connected to each other by a hinge mechanism. Each piston 103 is coupled to the peripheral portion of the swash plate 105. Accordingly, rotation of the lug plate 104 is converted to linear reciprocation of the piston 103 by the swash plate 105. The piston 103 is reciprocated between a top dead center position and a bottom dead center position. The hinge mechanism keeps the swash plate 105 inclined with respect to the drive shaft 101 so that a first point of the swash plate 105 is always located closest to the cylinder bores 102 and a second point of the swash plate 105, which is separated 180 degrees from the first point, is always located farthest from the cylinder bores 102. During rotation of the swash plate 105, the first point, or top dead center (TDC) point Qt, moves the corresponding piston 103 to the top dead center position and the second point, or bottom dead center (BDC) point Qb moves the corresponding piston 103 to the bottom dead center position.

A pair of guide pins 106*a*, 106*b* extend from the swash plate 105 toward the lug plate 104. The TDC point Qt is located between the guide pins 106*a*, 106*b* when viewed from a direction perpendicular to the front surface of the swash plate 105, as shown in FIG. 10. A support arm 107 extends from the lug plate 104 toward the TDC point Qt of the swash plate 105. The support arm 107 has guide bores 108*a*, 108*b* to slidably receive the guide pins 106*a*, 106*b*. The guide pins 106*a*, 106*b* and the support arm 107 form the hinge mechanism. The guide pins 106*a*, 106*b* apply force on the walls of the guide bores 108*a*, 108*b*, respectively. The force application point defines a support point Qr, which is separated from the drive shaft axis Li and located at a position corresponding to the top dead center side of the swash plate 105.

The displacement of the compressor is controlled by adjusting the inclination of the swash plate 105. The inclination is adjusted by changing the moment acting about the support point Qr. The moment may be changed by adjusting the crank chamber pressure Pc to alter the difference between the pressures acting on the ends of each piston 103, that is, the crank chamber pressure Pc and the pressure in the cylinder bores 102.

The pistons 103 located between the TDC point Qt and the BDC point Qb of the swash plate 105 in the rotating direction of the drive shaft 101, or the swash plate 105 (the pistons 103 located on the right-hand side as viewed in FIG. 6), each perform a certain stage of the compression stroke. During the compression stroke, each piston 103 moves toward the top dead center position from the bottom dead center position. The pistons 103 located between the BDC point Qb and the TDC point Qt of the swash plate 105 in the rotating direction of the swash plate 105 (the pistons 103 located on the left-hand side as viewed in FIG. 6) each perform a certain stage of the suction stroke. During the suction stroke, each piston 103 moves toward the bottom dead center position from the top dead center position.

With reference to FIG. 6, an imaginary plane M1 extends through the TDC point Qt, the BDC point Qb, and the axis L1. The compression reaction produced by the pistons 103 located on the compression stroke side of the imaginary plane M1 go applies pressure on the swash plate 105 that acts toward the lug plate 104. On the other hand, the vacuum pressure produced by the pistons 103 located on the suction stroke side of the imaginary plate M1 forms tension acting on the swash plate 105 toward the cylinder bores 102. Accordingly, forces acting on the swash plate 105 in opposite directions are produced simultaneously on each side of the imaginary plane M1.

As shown in FIG. 10, in the prior art compressor, the guide bores 108*a*, 108*b* are equally distanced from the surface of the lug plate 104 that faces the swash plate 105. More specifically, the cross-section of each guide bore 108*a*, 108*b* has a portion that is nearmost to the lug plate surface. The nearmost portion of the guide bores 108*a*, 108*b* are separated the same distance from the lug plate surface. Dimensional tolerances allowed during machining and assembly of the compressor forms a slight space C between the walls of the guide bores 108*a*, 108*b* and the associated guide pins 106*a*, 106*b*. (To facilitate understanding, each space C is illustrated in an exaggerated manner in FIGS. 9 and 10.) Thus, the movement of the guide pins 106*a*, 106*b* in the associated guide bores 108*a*, 108*b* produces torsion that acts on the swash plate 105. This may cause undesirable abrasion between the edge of the shaft bore 105*a* and the drive shaft 101. As a result, biased wear occurs at the portions where the drive shaft 101 and the swash plate 105 contact each other. When such biased wear occurs, continuous operation of the compressor may further increase the biased wear. This may loosen the fitting at such portions of contact and produce vibrations or noise.

SUMMARY OF THE INVENTION

Accordingly, it is an objective of the present invention to provide a variable displacement compressor that suppresses the production of torsion acting on the swash plate, or cam plate, during operation of the compressor, while reducing vibrations and noise.

To achieve the above objective, the present invention provides a structure for holding a cam plate in a compressor having a drive plate supported on a drive shaft for an integral rotation therewith. The cam plate is coupled to the drive plate by a hinge means to integrally rotate with the drive shaft and tilt with respect to the axis of the drive shaft. The cam plate is coupled to a piston to convert a rotation of the drive shaft into a linear reciprocating movement of the piston in a cylinder bore to compress gas supplied from an external circuit and discharge the compressed gas outward. The hinge means includes a first guide pin and a second guide pin respectively projecting from the cam plate to the drive plate. The drive plate has a first guide hole and a second guide hole respectively receiving the first guide pin and the second guide pin. The first guide hole is located closer to the cam plate i.e., farther away from the surface of the drive plate which face the cam plate, than the second guide hole.

Other aspects and advantages of the present invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

An embodiment of a variable displacement compressor according to the present invention will now be described with reference to FIGS. 1 to 8.

Figure 1:
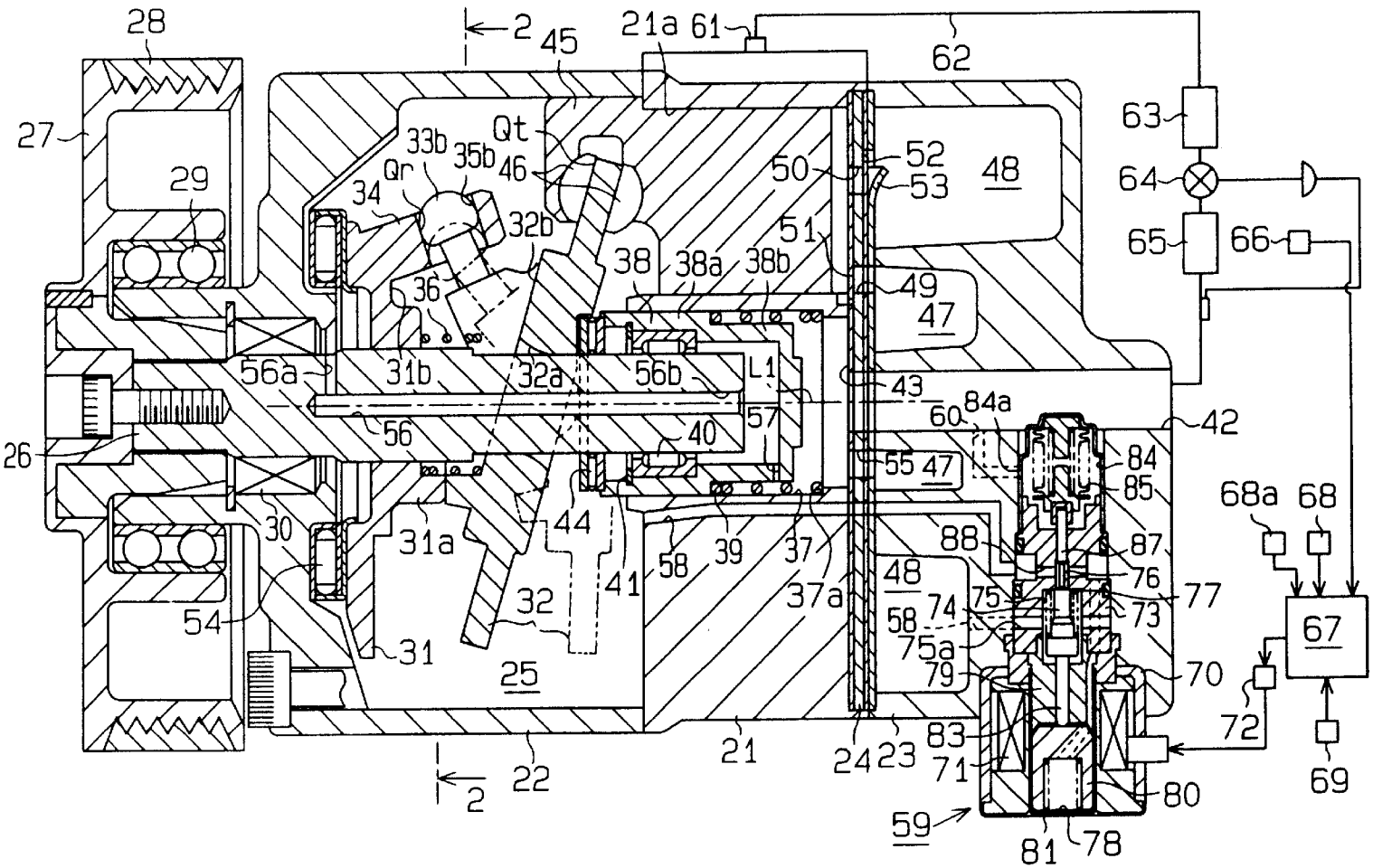
FIG. 1 is a cross-sectional view showing a variable displacement compressor according to the present invention.

As shown in FIG. 1, the compressor has a front housing 22 that is fixed to the front end of a cylinder block 21. A rear housing 23 is fixed to the rear end of the cylinder block 21 with a valve plate 24 arranged in between. The front housing 22, the cylinder block 21, and the rear housing 23 constitute a compressor housing. A crank chamber 25 is defined in the front housing 22 in front of the cylinder block 21. A drive shaft 26 is rotatably supported to extend through the crank chamber 25.

A pulley 27 is rotatably supported by means of an angular bearing 29 at the front wall of the front housing 22. The pulley 27 is coupled to the end of the drive shaft 26 projecting from the front housing 22. A belt 28 connects the pulley 27 directly with a vehicle engine (not shown). Thus, the compressor and the engine are directly connected to each other without employing a clutch mechanism such as an electromagnetic clutch.

A lip seal 30 seals the space between the front portion of the drive shaft 26 and the front housing 22. The lip seal 30 prevents the leakage of gas from the crank chamber 25.

A lug plate 31 is secured to the drive shaft 26 in the crank chamber 25. The lug plate 31 is supported to rotate integrally with the drive shaft 26. A swash plate 32, which serves as a cam plate, is accommodated in the crank chamber 25. The drive shaft 26 is inserted through a central bore 32*a* defined at the center of the swash plate 32. The swash plate 32 is supported by the drive shaft 26 in a manner enabling the swash plate 32 to slide along the axis L1 of the drive shaft 26 while inclining with respect to the drive shaft 26.

Figure 2:
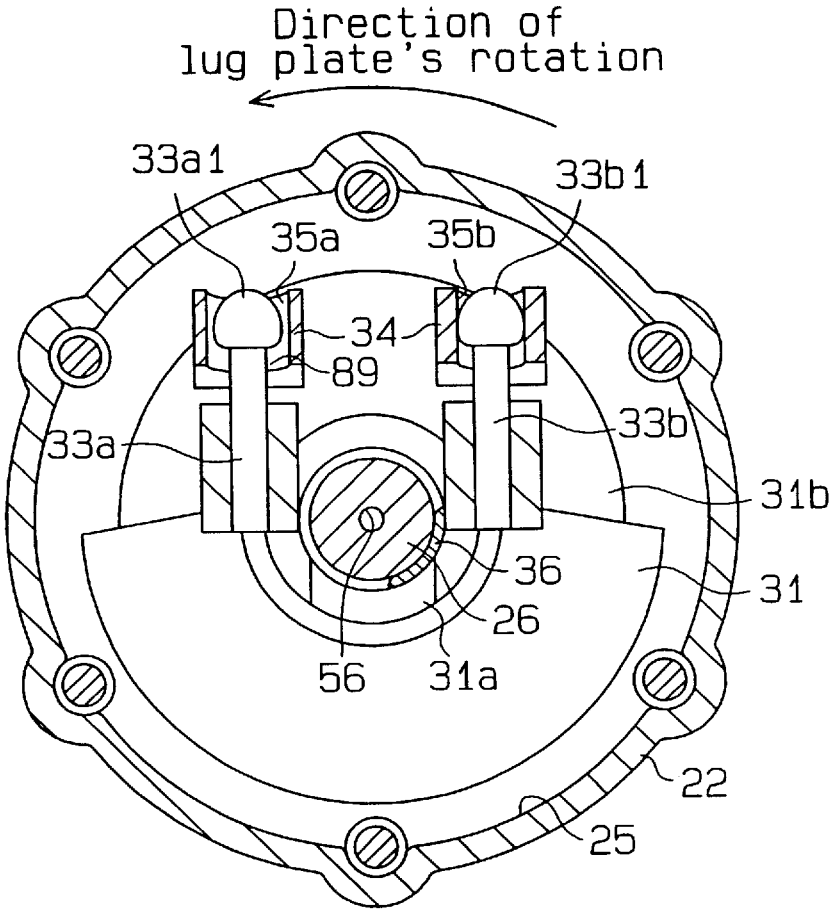
FIG. 2 is a cross-sectional view taken along line 2—2 in FIG. 1.
Figure 3:
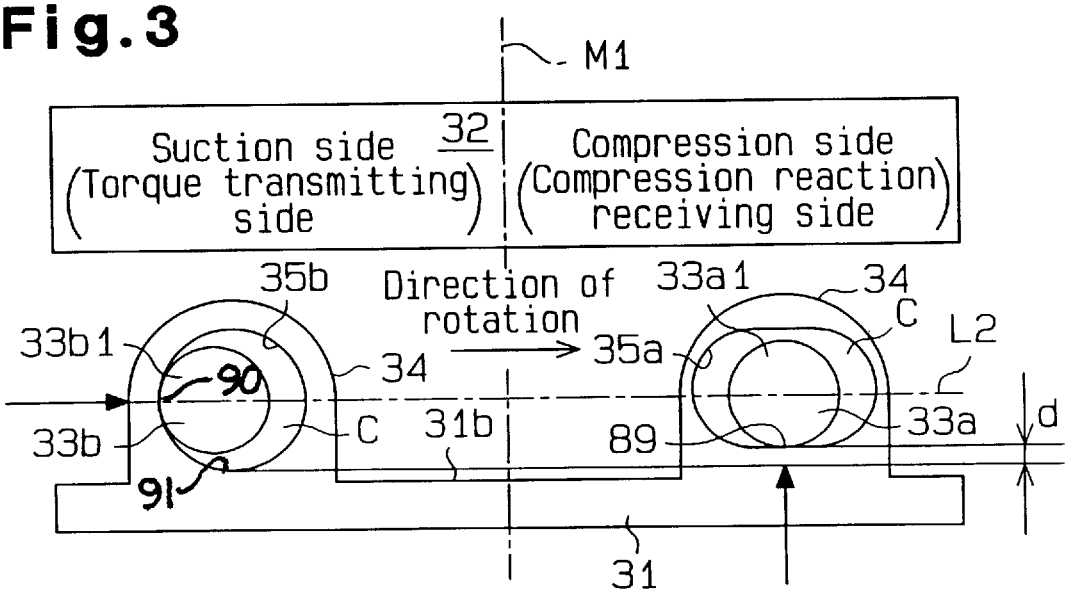
FIG. 3 is a diagrammatic view showing the hinge mechanism of FIG. 1.

As shown in FIGS. 1 to 3, the swash plate 32 has a front surface 32*b* facing the lug plate 31. A pair of guide pins 33*a*, 33*b* extend toward the lug plate 31 from the swash plate 32. The TDC point Qt of the swash plate 32 is located between the pins 33*a*, 33*b*. The guide pin 33*a* has a round end 33*a*1, while the guide pin 33*b* has a round end 33*b*1.

The lug plate 31 has a rear surface 31*b* facing the swash plate 32. A pair of support arms 34 extend from the rear surface 31*b* toward the swash plate 32 in correspondence with the guide pins 33*a*, 33*b*. Thus, the TDC point Qt is located between the support arms 34. A guide bore 35*a* extends through the end of one of the support arms 34, while another guide bore 35*b* extends through the end of the other support arm 34. The round ends 33*a*1, 33*b*1 of the guide pins 33*a*, 33*b* are slidably received in the guide bores 35*a*, 35*b*, respectively.

The round ends 33*a*1, 33*b*1 apply force on the walls of the guide bores 35*a*, 35*b*, respectively. The force application point defines a support point Qr, which is separated from the drive shaft axis L1 and located at a position corresponding to the top dead center side of the swash plate 32. The engagement between the support arms 34 and the guide pins 33*a*, 33*b* rotate the swash plate 32 integrally with the drive shaft 26 while permitting inclination of the swash plate 32 with respect to the drive shaft 26.

The engagement between the guide pins 33*a*, 33*b* and the associated guide bores 35*a*, 35*b* and between the swash plate 32 and the drive swash plate 32 guide the inclination of the shaft 26. The inclination of the swash plate 32 with respect to a direction perpendicular to the drive shaft axis L1 decreases as the central portion of the swash plate 32 moves toward the cylinder block 21.

A spring 36 is located between the lug plate 31 and the swash plate 32 to urge the swash plate 32 toward a direction that decreases the inclination of the swash plate 32. A stopper 31*a* projects from the rear surface 31*b* of the lug plate 31. The inclination of the swash plate 32 can be increased until the swash plate 31 abuts against the stopper 31*a*. Thus, the stopper 31*a* restricts further inclination of the swash plate 31. In this state, the swash plate 31 is arranged at a maximum inclination position.

Figure 4:
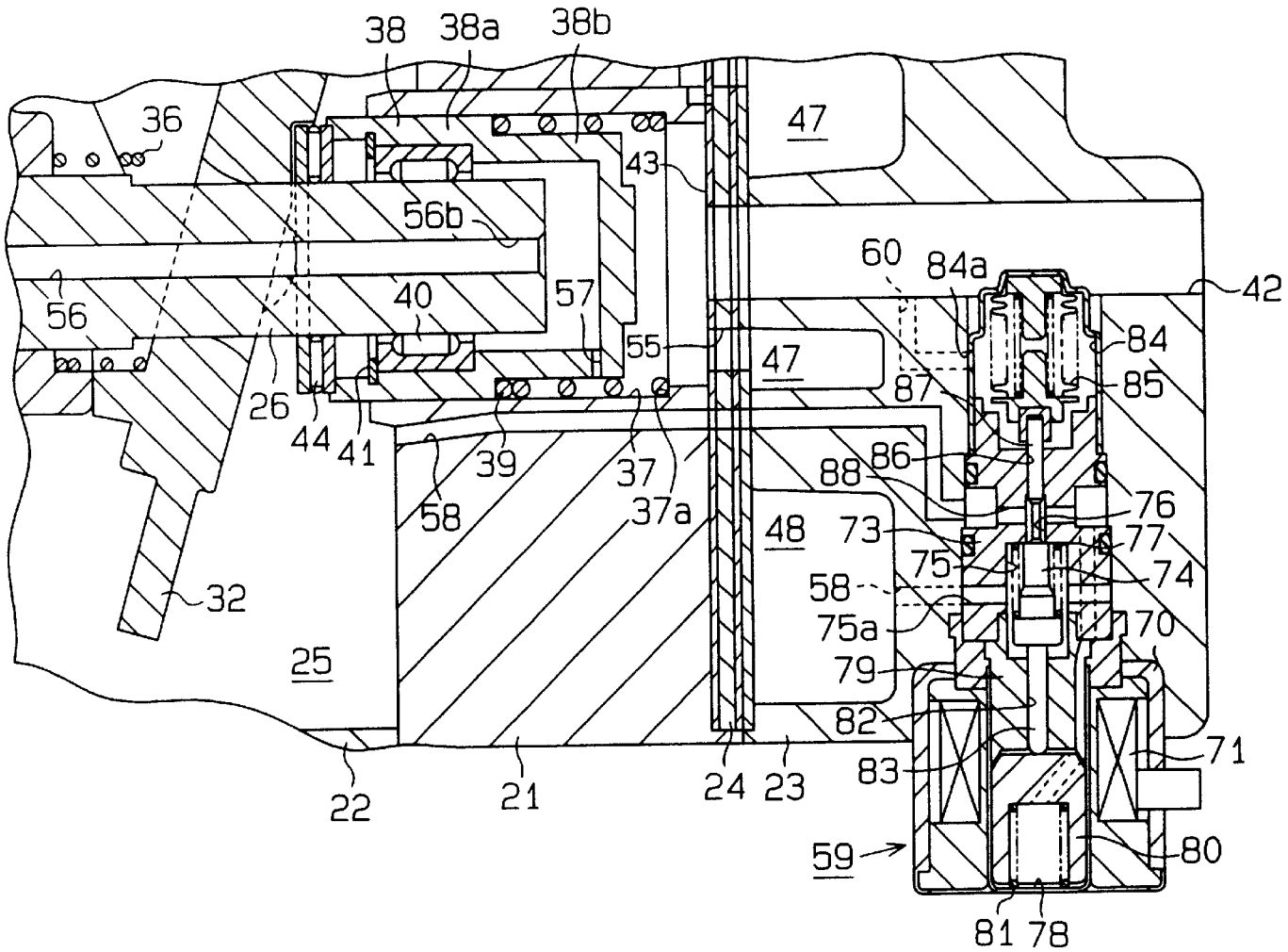
FIG. 4 is a partial, enlarged cross-sectional view showing the swash plate of FIG. 1 arranged at a maximum inclination position.
Figure 5:
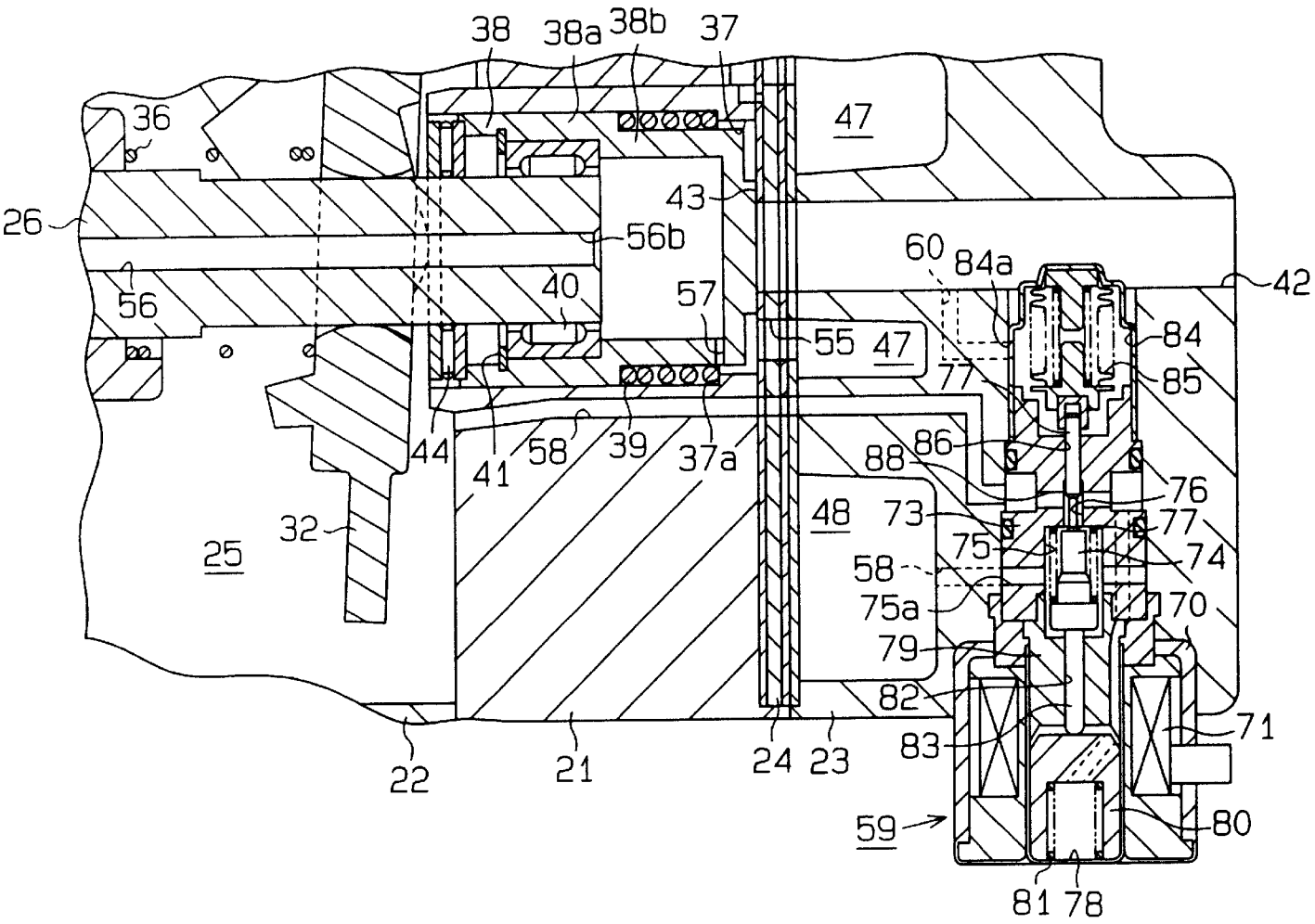
FIG. 5 is a partial, enlarged cross-sectional view showing the swash plate of FIG. 1 arranged at a minimum inclination position.

As shown in FIGS. 1, 4, and 5, a shutter bore 37 extends through the center of the cylinder block 21 coaxially with the drive shaft 26. A cup-shaped shutter 38 is slidably accommodated in the shutter bore 37. The shutter 38 has a large diameter portion 38*a* and a small diameter portion 38*b*. A first stepped portion 37*a* is defined on the wall of the shutter bore 37. A second stepped portion is defined between the large and small diameter portions 38*a*, 38*b*. A spring 39 is arranged in the shutter bore 37 between the first stepped portion 37*a* and the second stepped portion. The spring 39 urges the shutter 38 toward the swash plate 32.

The rear end of the drive shaft 26 is inserted into the shutter 38. A radial bearing 40 is fitted in the large diameter portion 38*a* and held therein by a snap ring 41. The radial bearing 40 and the shutter 38 are supported so that they slide together axially along the drive shaft 26.

A suction passage 42 extends through the center of the rear housing 23 coaxially with the drive shaft 26 and the shutter 38. The suction passage 42 is connected with the shutter bore 37. A positioning surface 43 is defined around the opening of the suction passage 42 on the valve plate 24. The end face defined on the small diameter portion 38*b* of the shutter 38 can pressed against the positioning surface 43. When the shutter 38 contacts the positioning surface 43, further inclination of the swash plate 32 is restricted. In this state, the swash plate 32 is arranged at a minimum inclination position.

A thrust bearing 44 is slidably arranged on the drive shaft 26 and located between the swash plate 32 and the shutter 38. The force of the spring 39 keeps the thrust bearing 44 held between the swash plate 32 and the shutter 38.

The inclination of the swash plate 32 decreases as the swash plate 32 slides along the drive shaft 16 toward the shutter 38. As the inclination of the swash plate 32 decreases, the swash plate 32 pushes the shutter 29 with the thrust bearing 44 toward the positioning surface 43 against the force of the spring 39. The thrust bearing 44 prevents the rotation of the swash plate 32 from being transmitted to the shutter 38.

As shown in FIG. 1, cylinder bores 21*a* (only one shown in the drawings) extend through the cylinder block 21. Each cylinder bore 21*a* retains a single-headed piston 45. Each piston 45 is coupled to the peripheral portion of the swash plate 32 by shoes 46. The rotation of the swash plate 32 is converted to linear reciprocation of the pistons 45.

A suction chamber 47 and a discharge chamber 48 are defined in the rear housing 23. For each cylinder bore 21*a*, the valve plate 24 has a suction port 49, a suction flap 51 for closing the suction port 49, a discharge port 50, and a discharge flap 52 for closing the discharge port 50. Refrigerant gas in the suction chamber 47 is drawn into each cylinder bore 21*a* through the suction port 51 as the associated piston 45 moves away from the valve plate 24 toward its bottom dead center position. The refrigerant gas drawn into the cylinder bore 21*a* is compressed to a predetermined pressure and then sent to the discharge chamber 48 through the discharge port 50 as the piston 45 moves back to the valve plate 24 toward its top dead center position. The angle of the discharge flaps 52 when opened is restricted by a retainer 53 fixed to the valve plate 24.

A thrust bearing 54 is arranged between the lug plate 31 and the front housing 22. The thrust bearing 54 receives the compression reaction that is produced during compression of the refrigerant gas and that is transmitted to the lug plate 31 by way of the pistons 45, the shoes 46, the swash plate 32, and the guide pins 33*a*, 33*b*.

As shown in FIGS. 1, 4, and 5, the suction chamber 47 is connected to the shutter bore 37 through an opening 55. When the shutting surface 43 of the shutter 38 abuts against the positioning surface 43, the opening 55 is disconnected from the suction passage 42. A conduit 56 extends through the drive shaft 26. The conduit 56 has an inlet 56*a* that is located near the lip seal 30 in the crank chamber 25 and an outlet 56*b* that is located in the shutter 38. A pressure releasing aperture 57 extends through the wall of the shutter 38 and connects the interior of the shutter 38 with the shutter bore 37.

A pressurizing passage 58 connects the discharge chamber 48 to the crank chamber 25. A displacement control valve 59 is arranged in the pressurizing passage 58. The control valve 51 is employed to close or open the pressurizing passage 58. A pressure detection chamber 60 extends between the suction passage 42 and the control valve 59 to communicate the suction pressure Ps in the suction passage 42 to the control valve 59.

The discharge chamber 48 is connected to a discharge block 61. The discharge block 61 and the suction passage 61 are connected to each other by an external refrigerant circuit 62. The external refrigerant circuit 62 includes a condenser 63, an expansion valve 64, and an evaporator 65.

A temperature sensor 66 is installed near the evaporator 65 to detect the temperature of the evaporator 65 and send a corresponding signal to a computer 67. A temperature adjuster 68 for designating the desired temperature in the passenger compartment, a passenger compartment temperature sensor 68*a*, and an air-conditioner switch 69 are also connected to the computer 67.

The control valve 59 has an electromagnetic portion 70. The magnitude of the electric current supplied to the electromagnetic portion 70 is calculated by the computer 67 based on various data. Such data include the temperature designated by the temperature adjuster 68, the temperatures detected by the temperature sensor 66 and the passenger compartment temperature sensor 68*a*, the signal representing the state of the air-conditioner switch 69, the engine speed, and other information. The electromagnetic portion 70 is driven by a driver circuit 72 in accordance with the value computed by the computer 67.

The control valve 59 includes a valve housing 73. The electromagnetic portion 70 and the valve housing 73 are located at the middle of the control valve 59. The control valve 51 is arranged in the pressurizing passage 58. A valve chamber 75 is defined between the electromagnetic portion 70 and the valve housing 73. The valve chamber 75 houses a valve body 74 and has a valve hole 76 facing the valve body 74. The valve hole 76 is co-axial with the valve housing 73. A spring 77 is arranged between the valve body 74 and the wall of the valve chamber 75 to urge the valve body 74 away from the valve hole 76. The valve chamber 75 is connected with the discharge chamber 48 through a valve port 75*a* and the pressurizing passage 58.

A core chamber 78 is defined in the electromagnetic portion 70 to house a fixed metal core 79 and a movable metal core 80. A spring 81 is arranged between the bottom wall of the core chamber 78 (as viewed in the drawing) and the movable core 80. A first guide passage 82, which connects the core chamber 78 and the valve chamber 75, extends through the fixed core 79. A solenoid rod 83 is inserted through the first guide passage 82 to operably connect the movable core 80 with the valve body 74. A solenoid 71 is arranged about the cores 79, 80. The solenoid 71 is excited by the driver circuit 72 based on commands sent from the computer 67.

A pressure chamber 84 is defined at the distal portion of the valve housing 73. The pressure chamber 84 is connected to the suction passage 42 by a pressure port 84*a* and a pressure passage 60. A bellows 85 is accommodated in the pressure chamber 84 and operably connected to the valve body 74 by way of a rod 87. A second guide passage 86, which is continuous with the valve hole 76, extends between the pressure chamber 84 and the valve chamber 75. A pressure rod 87 is inserted through the second guide passage 86 to operably connect the bellows 85 with the valve body 74. A port 88 extends through the valve housing 73 between the valve chamber 75 and the pressure chamber 84 in a direction perpendicular to the valve hole 76. The port 88 is connected to the crank chamber 25 through the pressurizing passage 58. The valve port 75*a*, the valve chamber 75, the valve hole 76, and the port 88 are part of the pressurizing passage 58.

As shown in FIGS. 2 and 3, in the preferred embodiment, the cross-sectional shape of the guide bore 35*a* differs from that of the guide bore 35*b*. Furthermore, the distance between the swash plate 32 and the portion nearmost to the rear surface 31*b* in the guide bore 35*a* differs from the distance between the swash plate 32 and the portion nearmost to the rear surface 31*b* in the guide bore 35*b*. The first guide bore 35*a*, which is located on the leading side of the lug plate 31 with respect to the rotating direction of the drive shaft 26, has a generally elongated circular cross-section. The first guide bore 35*a* has a flat wall surface portion 89 extending substantially parallel to the rear surface 31*b* of the lug plate 31. The second guide bore 35*b*, which is located on the following side, has a generally circular shape. The first guide bore 35*a* receives the first guide apin 33*a*, while the second guide bore 3*b* receives the second guide pin 33*b*.

The surface portion 89 (the portion closest to the rear surface 31*b* of the lug plate 31) of the first guide bore 35*a* is closer to the swash plate 32 than the nearmost portion of the second guide bore 35*b* by distance d. The offset distance d is determined such that a line L2, which extends through the center of the round end 33*a*1 of the first guide pin 33*a* and a contact surface portion or point 90 between the round end 33*b*l of the second guide pin 33*b* and the wall of the second guide bore 35*b*, is perpendicular to an imaginary plane M1, which lies along the TDC point Qt, the BDC point Qb, and the drive shaft axis L1. Thus, the respective centers of the round ends 33*a*1 and 33*b*1 are aligned with each other in the direction of rotation of the shaft 26.

The operation of the compressor will now be described. When the air-conditioner switch 69 is turned on, the computer 67 excites the electromagnetic portion 70 if the temperature detected by the passenger compartment temperature sensor 68*a* becomes greater than the temperature set by the temperature adjuster 68. As shown in FIGS. 1 and 4, this supplies electric current to the solenoid 71 by way of the driver circuit 72 in correspondence with the difference between the set temperature and the actual temperature. Excitation of the solenoid 71 generates an attractive force between the cores 79, 80 in accordance with the current value. As the magnitude of the attractive force increases, the solenoid rod 83 moves the valve body 74 against the force of the spring 77 and decreases the opened area of the valve hole 74.

The bellows 85 is deformed in accordance with changes in the suction pressure Ps drawn into the pressure chamber 84 from the suction passage 42 through the pressure passage 60. Deformation of the bellows 75 is transmitted to the valve body 74 by way of the pressure rod 87. The opening amount of the control valve 59 is determined in accordance with the forces produced by the electromagnetic portion 70, the bellows 85, and the spring 77.

When cooling of the passenger compartment is required, the temperature detected by the passenger compartment temperature sensor 68*a* is higher than the temperature designated by the temperature adjuster 68. In this state, the computer 67 commands the driver circuit 72 to increase the amount of electric current supplied to the solenoid 71 in accordance with the detected temperature. As the amount of electric current increases, the attractive force generated between the fixed core 79 and the movable core 80 increases. This increases the force acting on the valve body 74 and decreases the opened area of the valve hole 76.

As a result, the opened area of the control valve 59 decreases and the amount of high-pressure refrigerant gas sent from the discharge chamber 48 to the crank chamber 25 decreases. The refrigerant gas in the crank chamber 25 enters the suction chamber 47 though the conduit 56, the interior of the shutter 38, the pressure releasing aperture 57, the shutter bore 37, and the opening 55. Consequently, the pressure Pc of the crank chamber 25 is decreased.

Furthermore, when cooling of the passenger compartment is required, the temperature of the evaporator 65 in the external refrigerant circuit 62 is high. Thus, the pressure of the refrigerant gas returning to the suction chamber 47 is high. Accordingly, the difference between the crank chamber pressure Pc and the pressure in the cylinder bores 21*a* becomes small. As a result, the change in the moment applied about each support point Qr, or the point of contact between the round ends 33*a*1, 33*b*1 and the walls of the associated guide bores 35*a*, 35*b*, increases the inclination of the swash plate 32. This increases the amount of refrigerant gas drawn into each cylinder bore 21*a* from the suction chamber 47 and increases the displacement. Furthermore, the compressor is operated with a lower suction pressure Ps.

When the amount of refrigerant gas passing through the pressurizing passage 58 becomes null, that is, when the control valve 59 is completely closed, the flow of high-pressure refrigerant gas from the discharge chamber 48 to the crank chamber 25 is stopped. The crank chamber pressure Pc then becomes substantially the same as the suction chamber pressure Ps and moves the swash plate 32 to the maximum inclination position. In this state, displacement of the compressor is maximum.

When cooling of the passenger compartment becomes unnecessary, the difference between the temperature detected by the passenger compartment temperature sensor 68*a* and the temperature designated by the temperature adjuster 68 is small. In this state, the computer 67 commands the driver circuit 72 to decrease the amount of electric current supplied to the solenoid 71 in accordance with the detected temperature. As the amount of electric current decreases, the attractive force generated between the fixed core 79 and the movable core 80 decreases. This decreases the force acting on the valve body 74 to decrease the opened area of the valve hole 76.

As a result, the opened area of the control valve 59 increases and the amount of high-pressure refrigerant gas sent from the discharge chamber 48 to the crank chamber 25 increases. The amount of refrigerant gas supplied to the crank chamber 25 exceeds the amount of refrigerant gas escaping the crank chamber 25. Thus, the crank chamber pressure Pc increases.

Furthermore, when cooling of the passenger compartment is unnecessary, the temperature of the evaporator 65 is low. Thus, the pressure of the refrigerant gas returning to the suction chamber 47 is low. Accordingly, the difference between the crank chamber pressure Pc and the pressure in the cylinder bores 21*a* becomes large. As a result, the change in the moment applied about each support point Qr decreases the inclination of the swash plate 32. This decreases the amount of refrigerant gas drawn into each cylinder bore 21*a* and operates the compressor with a higher suction pressure Ps.

As the necessity to cool the passenger compartment becomes small, the temperature of the evaporator 65 falls to a temperature at which frost starts to form. When the temperature detected by the temperature sensor 66 becomes lower than a predetermined temperature (a temperature at which frost starts to form), the computer 67 de-excites the electromagnetic portion 70 by way of the drive circuit 72. This eliminates the attractive force generated between the fixed core 79 and the movable core 80.

Consequently, the force of the spring 77 moves the valve body 74 downward (as viewed in FIG. 5) against the force of the spring 81, which acts by way of the movable core 80 and the solenoid rod 83. As the valve body 74 completely opens the valve hole 76, a large amount of high-pressurized refrigerant gas is sent into the crank chamber 25 through the pressurizing passage 58. This increases the crank chamber pressure Pc. The pressure increase moves the swash plate 32 to a minimum inclination position.

When the switch 69 is turned off, the computer 67 de-excites the electromagnetic portion 70. Accordingly, the inclination of the swash plate 32 is minimized.

As described above, the control valve 59 is controlled in accordance with the magnitude of the current supplied to the solenoid 71 of the electromagnetic portion 70. When the magnitude of the current is increased, the control valve 59 opens and closes the valve hole 76 at a lower suction pressure Ps. When the magnitude of the current is decreased, on the other hand, the control valve 59 opens and closes the valve hole 76 at a higher suction pressure Ps. The compressor varies displacement by changing the inclination of the swash plate 32 to achieve the target suction pressure Ps.

Accordingly, the control valve 59 functions to change the target value of the suction pressure Ps by altering the current supplied to the solenoid 71 and to operate the compressor in a minimum displacement state regardless of the suction pressure Ps. Thus, the employment of the control valve 59 results in the compressor altering the cooling it performance of the refrigerant circuit.

When the inclination of the swash plate 32 is minimum as illustrated in FIG. 5, the shutter 38 abuts against the positioning surface 43. The abutment disconnects the suction passage 42 from the shutter bore 37 thereby stopping the flow of refrigerant gas from the refrigerant circuit 62 to the suction chamber 47. When the swash plate 32 is arranged at the minimum inclination position, the angle formed between the swash plate 32 and a direction perpendicular to the drive shaft axis L1 is slightly greater than zero degrees. The swash plate 32 moves the shutter 38 between a closed position for disconnecting the suction passage 42 from the shutter bore 37 and an opened position for connecting the passage 42 with the bore 37.

Since the minimum inclination of the swash plate 32 is more than zero degrees, refrigerant gas in the cylinder bores 21*a* is discharged to the discharge chamber 48 even if the inclination of the swash plate 32 is minimum. In this state, the refrigerant gas in the discharge chamber 48 enters the crank chamber 25 through the pressurizing passage 58. The refrigerant gas in the crank chamber 25 is drawn back into the suction chamber 47 through the conduit 56, the interior of the shutter 38, the pressure releasing aperture 57, the shutter bore 37, and the opening 55. The refrigerant gas in the suction chamber 47 is drawn into the cylinder bores 21*a* and is again discharged to the discharge chamber 48.

That is, when the swash plate 32 is arranged at the minimum inclination position, refrigerant gas circulates within the compressor. The gas travels through the discharge chamber 48, the pressurizing passage 58, the crank chamber 25, the conduit 56, the interior of the shutter 38, the pressure releasing aperture 57, the shutter bore 37, the opening 55, the suction chamber 47, and the cylinder bores 21*a*. In this state, the pressures in the discharge chamber 48, the crank chamber 25, and the suction chamber 47 differ from one another. The circulation of refrigerant gas lubricates the moving parts of the compressor with the lubricant oil suspended therein.

When the air-conditioner switch 69 is turned on and the swash plate 32 is arranged at the minimum inclination position, an increase in the passenger compartment temperature may result in the compartment temperature exceeding the temperature designated by the temperature adjuster 68. In this case, the computer 57 commands the driver circuit 72 to excite the electromagnetic portion 70 and close the pressurizing passage 58 based on the detected temperature increase. The pressure in the crank chamber 25 is released into the suction chamber 47 through the conduit 56, the interior of the shutter 38, the pressure releasing aperture 57, the shutter bore 37, and the opening 55. This lowers the crank chamber pressure Pc. Accordingly, the spring 39 expands from the state of FIG. 5. Thus, the spring 39 moves the shutter 38 away from the positioning surface 43 and increases the inclination of the swash plate 32 from the minimum inclination position.

As the shutter 38 moves away from the positioning surface 43, the opened area of the suction passage 42 increases gradually. This gradually increases the amount of refrigerant gas drawn into the suction chamber 47 from the suction passage 42. Since the amount of refrigerant gas drawn into the cylinder bores 47 from the suction chamber 47 also increases, the displacement and the discharge pressure Pd increases gradually. Accordingly, the load on the compressor changes in a gradual manner. Thus, when the displacement changes from a minimum state to a maximum state, the load on the compressor changes gradually and prevents generation of shocks, which may be felt by the vehicle passengers.

If the engine is stopped, the compressor is also stopped, that is, the rotation of the swash plate 32 is stopped, and the supply of current to the solenoid 71 is stopped. Therefore, the electromagnetic portion 70 is de-excited to open the pressurizing passage 58. If the non-operational state of the compressor continues, the pressures in the chambers of the compressor equalize and the swash plate 32 is kept at the minimum inclination by the force of spring 36. Therefore, when the engine is started again, the compressor starts operating with the swash plate 32 at the minimum inclination position, which requires the minimum moment.

Figure 6:
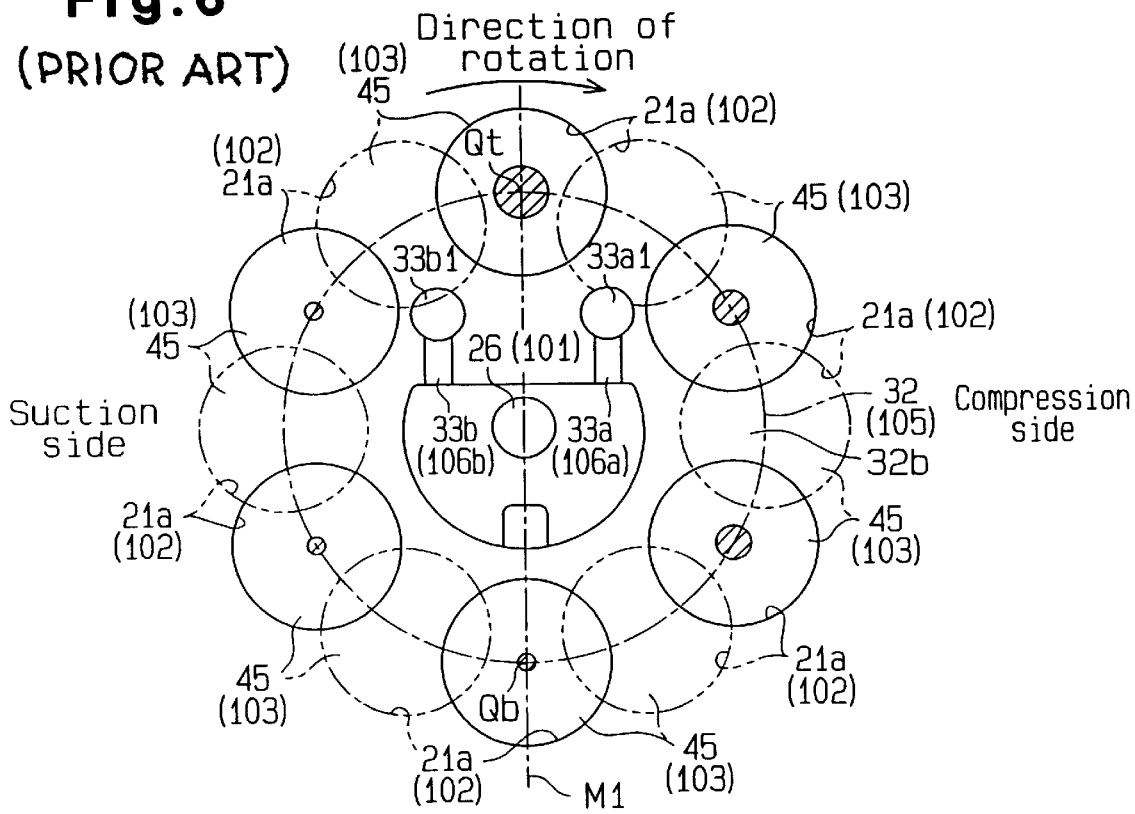
Fig.6 (PRIOR ART)
FIG. 6 is a diagrammatic view showing the positional relationship between the guide pins and the cylinder bores.

With reference to FIG. 6, compression reaction is produced by the pistons 45 located on the compression stroke side of the imaginary plane M1 (the right-hand side as viewed in the drawing), which lies along the TDC point Qt, the BDC point Qb, and the drive shaft axis L1. Thus, the compression stroke side pistons 45 apply force, which acts toward the lug plate 31, on the swash plate 32. The pistons 45 located on the suction stroke side of the imaginary plane M1 (the left-hand side as viewed in the drawing) produces vacuum pressure in the associated cylinder bores 21*a*. Tension resulting from the vacuum pressure is applied to the ah swash plate 32 by the suction stroke side pistons 45. The tension acts toward the cylinder bores 21*a*. Accordingly, forces acting on the swash plate 105 in opposite directions are produced simultaneously on each side of the imaginary plane M1. In the drawing, the size of the circle illustrated at the center of each cylinder bore 21*a* shows the strength of the pressure in that cylinder bore 21*a*. A larger circle represents a higher pressure.

Among the two guide pins 33*a*, 33*b*, the first guide pin 33*a* is located at the leading side with respect to the direction of rotation of the swash plate 32, as indicated by the arrow. The second guide pin 33*b* is located at the retarded side. During operation of the compressor, compression reaction is produced by the reciprocation of the pistons 45. This causes the round end 33*a*1 of the guide pin 33*a* to abut against the flat wall 89 of the associated guide bore 35*a*1. Furthermore, the round end 33*b*1 of the second guide pin 33*b* abuts against the rearwardmost portion 90 of the wall of the second guide bore 35*b*. In this state, the compression reaction acting on the swash plate 32 during reciprocation of the pistons 45 is received by the lug plate 31 mainly through the first guide pin 33*a*. The moment produced by the rotation of the lug plate 31 is transmitted to the swash plate 32 mainly through the second guide pin 33*b*.

Dimensional tolerances allowed during the manufacture of the compressor make it difficult to perfectly fit the round ends 33*a*1, 33*b*1 of the respective guide pins 33*a*, 33*b* into the associated guide bores 35*a*, 35*b*. In other words, a space C would be formed between each round end 33*a*1, 33*b*1 and the wall of the associated guide bore 35*a*, 35*b* as shown in FIG. 3. The space C may cause relative movement between the round ends 33*a*1, 33*b*1 and the wall of the associated guide bore 35*a*, 35*b*. To facilitate understanding, the space C is illustrated in an exaggerated manner.

However, the portion 89 nearest to the rear surface 31*b* of the lug plate 31 in the first guide bore 35*a* is offset by distance d away from the lug plate surface 31*b*, toward the swash plate 32 portion in the second guide bore 35*b*. Therefore, the movement of the round end 33*a*1 of the guide pin 33*a* toward the lug plate 31 is restricted by the portion 89 even when compression reaction acts on the swash plate 32.

Accordingly, relative movement between the guide pins 33*a*, 33*b* is reduced and the magnitude of torsion acting on the swash plate 32 is decreased. This reduces contact between the wall edge of the swash plate central bore 32*a* and the drive shaft 26. Thus, biased wear is suppressed at the portions where the drive shaft 26 and the swash plate 32 contact each other.

Furthermore, the round end 33*b*1 of the second guide pin 33*b* abuts against the rearwardmost portion 90 of the wall of the second guide bore 35*b* during operation of the compressor. During rotation of the lug plate 31, the round end 33*b*1 is guided along the wall of the second guide bore 35*b* to the rearwardmost portion 90 and held at this position. This further reduces relative movement between the guide pins 33*a*, 33*b* and suppresses biased wear at the portions where the drive shaft 26 and the swash plate 32 contact each other.

Figure 7:
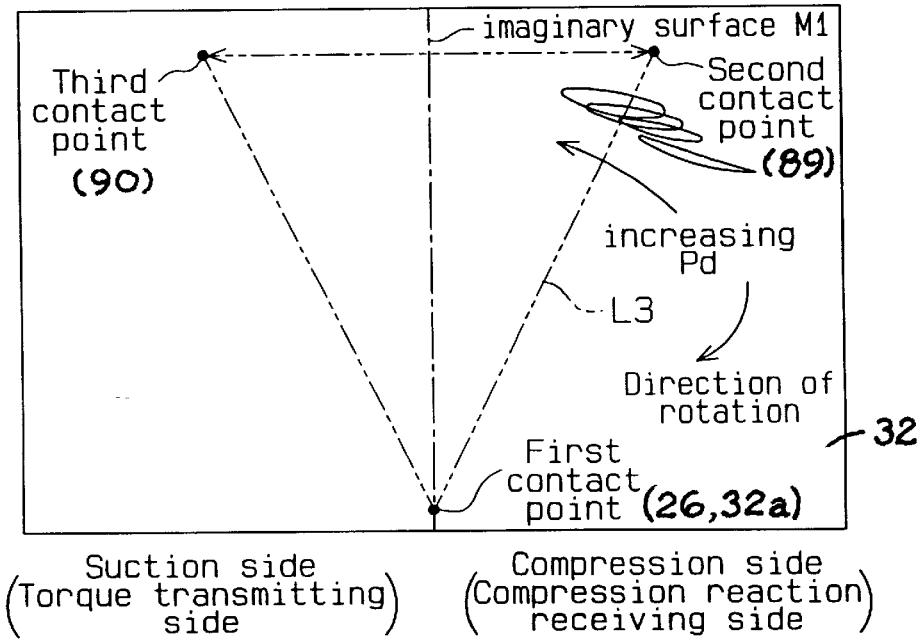
FIG. 7 is a diagram showing the displacement of the center of load of compression reaction with respect to changes in the discharge pressure.

As shown in FIG. 7, the swash plate 32 is supported at three points. The first contact point is the point of contact between the drive shaft 26 and the wall of the swash plate central bore 32*a*. The second contact point is the point of contact 89 between the wall of the first guide bore 35*a* and the round end 33*a*1 of the first guide pin 33*a*. The third contact 90 point is the point of contact between the wall of the second guide bore 35*b* and the round end 33*b*1 of the second guide pin 33*b*.

As shown in FIG. 6, the compressor of the preferred embodiment has six cylinder bores 21*a*. Thus, as the swash plate 23 rotates every one sixth of a rotation (60 degrees), the TDC point Qt of the swash plate 32 becomes located at a position corresponding to the axis of a cylinder bore 21*a*. During the one sixth rotation, the location of the center of load of the compression reaction, which is produced by the reciprocation of the pistons 45, changes in a circular manner as shown in FIG. 7. Thus, the load center is distributed within a circular area. Such displacement of the center of load occurs in a cyclic manner, that is, one cycle for every sixth rotation. The load center distribution moves in a direction opposite to the rotating direction of the drive shaft 36. When the discharge pressure Pd is low, the load center distribution is located on the forward side of a line L3, which extends between the first point and the second point, with respect to the rotating direction of the swash plate 32. However, when the discharge pressure Pd becomes high, the load center distribution lies across line L3.

Figure 10:
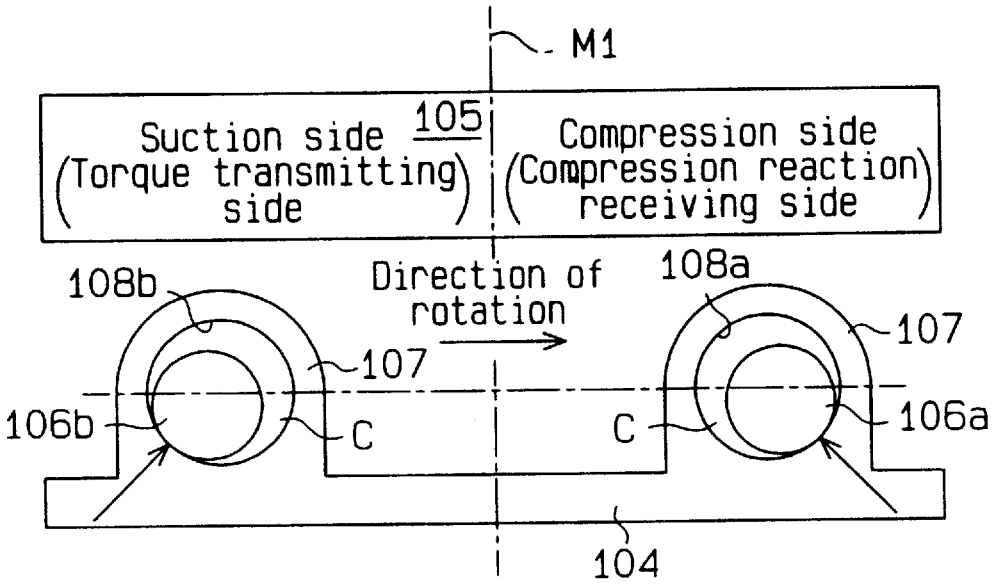
Fig.10 (Prior Art)
FIG. 10 is a diagrammatic view showing the prior art hinge mechanism.
Figure 11:
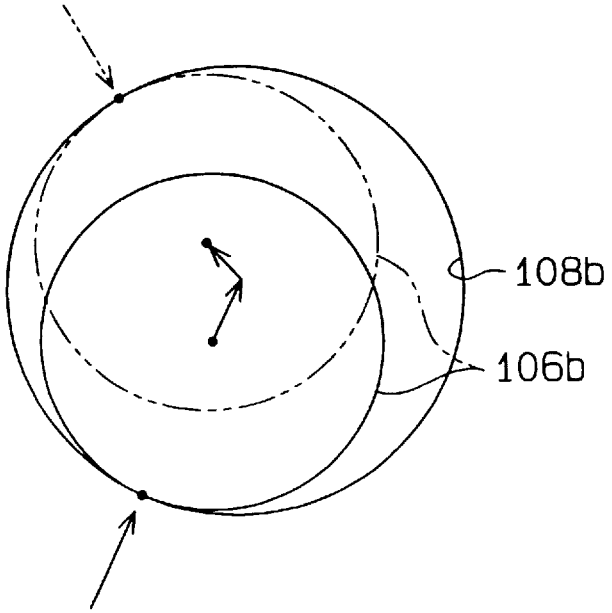
Fig.11 (Prior Art)
FIG. 11 is a diagrammatic view showing collision of a guide pin against the wall of a guide bore in the prior art.

In the prior art structure illustrated in FIG. 10, if the compressor is operated with the load center distribution lying across line L3, the second guide pin 106*b*, which is located on the following side, collides against the wall of the second guide bore 108*b* repetitively as shown in FIG. 11. This produces noise and vibrations.

When the load center distribution lies across line L3, the force applied to the first guide pin 106*a*, which is located on the leading side and which receives the compression reaction mainly, by the wall of the first guide bore 108*a* changes directions. The change in the direction of the force applies a pivoting force to the second guide pin 106 about the first guide pin 106*a*. Thus, the second guide pin 106*b*, to which moment is transmitted, is separated from the wall of the second guide bore 108*b* instantaneously. Since the rotation of the drive shaft 101 continues during this period, the lug plate 104 is also rotated. Thus, the second guide pin 106*b* collides against the wall of the second guide bore 108*b*.

However, in the compressor of the preferred embodiment, the round end 33*a*1 of the first guide pin 33*a* abuts against the flat wall at the surface portion 89 of the first guide bore 35*a*. Thus, the force applied to the first guide pin 33*a* by the wall of the first guide bore 35*a* due to the compression reaction is constantly parallel to the drive shaft 26. Thus, when the discharge pressure Pd is high, the pivoting force acting on the round end 33*b*1 of the second guide pin 33*b* is suppressed even when the center of load of the compression reaction is distributed across line L3.

In addition, when the compressor is operated, the round end 33*b*1 of the second guide pin 33*b* abuts against the rearwardmost portion at the surface point 90 on the wall of the second guide bore 35*b* with respect to the rotating direction of the swash plate 32. Thus, the round end 33*b*1 pivots along the wall of the second guide bore 35*b* when a pivoting force acts on the round end 33*b*1. This prevents separation of the round end 33*b*1 from the wall of the second guide bore 35*b*. Thus, collision between the round end 33*b*1 and the wall of the second guide bore 35*b* does not occur. Accordingly, noise and vibrations are reduced when the discharge pressure Pd is high.

In the compressor according to the preferred embodiment, the portion of the first guide bore 35*a* nearmost to the rear surface 31*b* of the lug plate 31 is offset toward the swash plate 32 from that of the second guide bore 35*b*.

Therefore, the movement of the first guide pin 33*a* caused by the compression reaction resulting from the reciprocation of the pistons 45 is restricted. This decreases relative movement between the guide pins 33*a*, 33*b* and reduces the magnitude of the torsion acting on the swash plate 32. Furthermore, contact between the wall edge of the swash plate central bore 32 and the drive shaft 26 is suppressed. Thus, biased wear is suppressed at the portions where the drive shaft 26 and the swash plate 32 contact each other. Accordingly, vibrations and noise, which may be caused by loosening resulting from wear, is suppressed.

Line L2, which extends through the center of the round end 33*a*1 of the first guide pin 33*a* and the contact point 90 between the round end 33*b*1 of the second guide pin 33*b* and the wall of the second guide bore 35*b*, is perpendicular to the imaginary plane M1.

Thus, when the compressor is operated, the round end 33*b*1 of the second guide pin 33*b* abuts against the rearwardmost most portion 90 of the wall of the second guide bore 35*b* with respect to the rotating direction of the swash plate 32 and held at this position. This further reduces relative movement between the guide pins 33*a*, 33*b* and suppresses biased wear at the portions where the drive shaft 26 and the swash plate 32 contact each other. Accordingly, vibrations and noise, which may be caused by loosening resulting from wear, is further suppressed.

The first guide bore 35*a* is provided with the flat wall 89. This easily absorbs the dimensional differences allowed during machining and assembly of the compressor. Thus, production costs are reduced and assembly is facilitated.

It should be apparent to those skilled in the art that the present invention may be embodied in many other specific forms without departing from the spirit or scope of the invention. More particularly, the present invention may be embodied in the modes described below.

Figure 8:
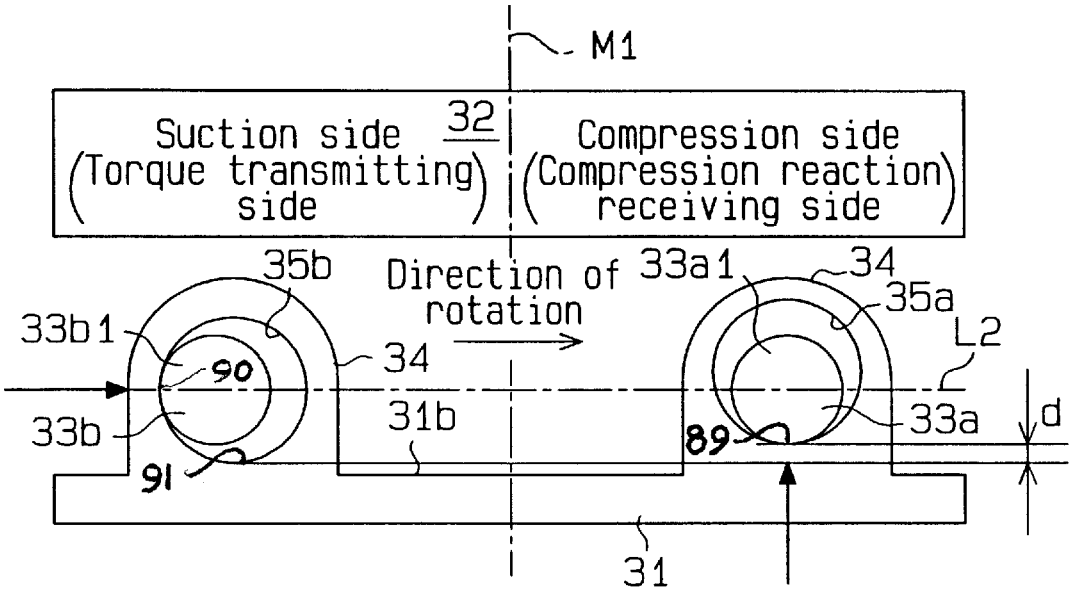
FIG. 8 is a diagrammatic view showing a hinge mechanism employed in a further embodiment according to the present invention.

The preferred and illustrated embodiment may be modified as shown in FIG. 8. That is, the first guide bore 35*a* may have a substantially circular cross-section. In this case, the portion of the wall of the first guide bore 35*a* nearest to the rear surface 31*b* of the lug plate 31 is located closer to the swash plate 32, i.e., farther from the surface 31*b* than the corresponding portion of the second guide bore 35*b* by the distance of in the same manner as the embodiment of FIGS. 1 to 7.

This restricts movement of the first guide pin 33*a* toward the lug plate 31 and suppresses torsion of the swash plate 32 caused by reciprocation of the pistons 45. Furthermore, this structure facilitates machining of the first guide bore 35*a*. It has also been confirmed that the round end 33*b*1 of the second guide pin 33*b* does not separate from or collide against the wall of the second guide bore 35*b*.

In the preferred and illustrated embodiment of FIGS. 1 to 7, the second guide bore 35*b* may have an elongated circular cross-section. Such structure has the same advantages as the embodiment of FIGS. 1 to 7.

Therefore, the present examples and embodiments are to be considered as illustrative and not restrictive, and the invention is not to be limited to the details given herein, but may be modified within the scope and equivalence of the appended claims.

What is claimed is:

1. A structure for holding a cam plate in a compressor having a lug plate supported on a compressor drive shaft for integral rotation therewith, said cam plate being coupled to the lug plate by hinge means to integrally rotate with the drive shaft and to tilt with respect to the axis of the drive shaft, said cam plate being coupled to a piston to convert rotation of the drive shaft into linear reciprocating movement of the piston within a cylinder to compress a compressible gas supplied to the cylinder from an external gas circuit and to discharge the compressed gas outward from the cylinder during piston compression movement, said lug plate having a surface facing towards said cam plate, said hinge means comprising:

a first guide pin and a second guide pin respectively projecting from said cam plate to said lug plate, said first and second guide pins being aligned with each other in annularly spaced apart relation in the direction of said rotation of the drive shaft with said first guide pin being in a leading position, and said second guide pin being in a following position with respect to the other guide pin;

said lug plate having respective first and second support arms projecting substantially from said lug plate surface and being in similar annularly spaced apart relation in the direction of said rotation of the drive shaft for respective engagement by said cam plate first and second guide pins, said first support arm having a first guide hole receiving said first guide pin in engagement therewith on a surface portion of the first guide hole which is nearest to said drive plate surface, and said second support arm having a second guide hole receiving said second guide pin in engagement therewith on a surface portion of the second guide hole which is annularly displaced an angular distance towards the following direction of said rotation of the drive shaft from a surface portion of the second guide hole which is nearest to said lug plate surface; and said surface portion of the first guide hole which is nearest to said lug plate surface being located a greater distance away from said lug plate surface than is said second guide hole surface portion which is nearest to said lug plate surface.

2. The structure according to claim 1, wherein said first guide hole has a laterally elongated shape in the direction of said rotation of the drive shaft thereby providing a substantially linear surface portion of said first guide hole which includes said surface portion of the first guide hole which is nearest to said lug plate surface.

3. The structure according to claim 1, wherein said cam plate is a swash plate.

4. The structure according to claim 1, wherein said greater distance is substantially equal to an anticipated distance of compression reaction movement of said cam plate towards said lug plate during said piston compression movement.

5. The structure according to claim 4, wherein said linear reciprocating movement of the piston is between a top dead center position and a bottom dead center position of the piston within said cylinder during one rotation of the cam plate, said cam plate having a first point corresponding to said top dead center position and a second point corresponding to said bottom dead center position of the piston, said first and second guide pins being respectively located on opposite sides of, and at substantially equal distances from an imaginary line extending between said first and second points on said cam plate.

6. The structure according to claim 1, wherein each of said first and second guide holes has circular shape.

7. The structure according to claim 1, wherein said second guide hole receives said second guide pin in engagement therewith on a surface portion of the second guide hole which is annularly displaced an angular distance of substantially ninety degrees (90°) towards the following direction of said rotation of the drive shaft from said second surface of said second guide hole which is nearest to said lug plate surface.

8. A structure for holding a swash plate in a compressor having a lug plate supported on a compressor drive shaft for integral rotation therewith, said swash plate being coupled to the lug plate by hinge means to integrally rotate with the drive shaft and to tilt with respect to the axis of the drive shaft, said swash plate being coupled to a piston to convert rotation of the drive shaft into linear reciprocating movement of the piston within a cylinder to compress a compressible gas supplied to the cylinder from an external gas circuit and to discharge the compressed gas outward from the cylinder during piston compression movement, said lug plate having a surface facing towards said swash plate, said hinge means comprising:

a first guide pin and a second guide pin respectively projecting from said swash plate to said lug plate, each of said guide pins having a substantially spherical end, said first and second guide pins being aligned with each other in annularly spaced apart relation in the direction of said rotation of the drive shaft with said first guide pin being in a leading position, and said second guide pin being in a following position with respect to the other guide pin;

said lug plate having respective first and second guide holes in similar annularly spaced apart relation to each other in the direction of said rotation of the drive shaft for respective engagement by said swash plate first and second guide pin spherical ends, said first guide hole receiving said first guide pin spherical end in engagement therewith on a surface portion of the first guide hole which is nearest to said lug plate surface, and said second guide hole receiving said second guide pin spherical end in engagement therewith on a surface portion of the second guide hole which is annularly displaced substantially towards the following direction of said rotation of the drive shaft from a surface portion of the second guide hole which is nearest to said lug plate surface; and said surface portion of the first guide hole which is nearest to said lug plate surface being located at a greater distance away from said lug plate surface than said surface portion of the second guide hole which is nearest to said lug plate surface, said greater distance being substantially equal to an anticipated distance of compression reaction movement of said swash plate towards said lug plate during said piston compression movement.

9. A compressor comprising:

a housing having a cylinder bore;

a drive shaft supported by the housing;

a cam plate supported by the drive shaft;

a piston coupled to the cam plate to reciprocate in the cylinder bore to compress gas supplied from an external circuit and to discharge the compressed gas;

a drive plate supported on the drive shaft for integral rotation therewith; and a hinge coupling the cam plate to the drive plate for causing the cam plate to integrally rotate with the drive shaft and to permit the cam plate to tilt with respect to the axis of the drive shaft, wherein the hinge has a first guide pin and a second guide pin respectively projecting from the cam plate toward the drive plate, the first guide pin being in a leading position and the second guide pin being in a following position with respect to the direction of said rotation, wherein the drive plate has a first guide hole and a second guide hole which respectively receive the first guide pin and the second guide pin in engagement therewith wherein the second guide hole extends farther in the axial direction of the drive shaft, away from the cam plate, than the first guide hole whereby the location of engagement of the second guide pin in the second guide hole is angularly displaced from the location of engagement of the first guide pin in the first guide hole.

10. The compressor as set forth in claim 9, wherein said guide pins each include a spherical portion.

11. The compressor as set forth in claim 10, wherein the first guide hole has a laterally elongated shape in the direction of said rotation providing a planar portion facing the cam plate.

12. The compressor as set forth in claim 11, wherein said drive plate is a lug plate.

13. The compressor as set forth in claim 12, wherein said cam plate is a swash plate.

14. A compressor comprising:

a housing having a cylinder bore;

a drive shaft supported by the housing;

a cam plate supported by the drive shaft;

a piston coupled to the cam plate to reciprocate in the cylinder bore to compress gas supplied from an external circuit and to discharge the compressed gas;

a drive plate supported on the drive shaft for integral rotation therewith; and a hinge coupling the cam plate to the drive plate for causing the cam plate to integrally rotate with the drive shaft and to permit the cam plate to tilt with respect to the axis of the drive shaft, wherein the hinge includes:

a first guide pin projecting toward the drive plate from the cam plate; and a second guide pin projecting toward the drive plate from the cam plate in a position trailing the first guide pin with respect to the direction of rotation of the cam plate wherein said drive plate has a first guide hole that receives the first guide pin and a second guide hole that receives the second guide pin, wherein the second guide hole extends farther in the axial direction of the drive shaft, away from the cam plate, than the first guide hole by a predetermined distance, wherein the predetermined distance is based on the anticipated movement of the cam plate due to forces applied to the cam plate during rotation.

15. The compressor as set forth in claim 14, wherein said piston carries out a reciprocating movement between a top dead center position and a bottom dead center position in association with one rotation of the cam plate, wherein said cam plate has a first point corresponding to the top dead center position and a second point corresponding to the bottom dead center portion, wherein said first guide hole and said second guide hole respectively have inner peripheral surfaces that contact the first guide pin and the second guide pin at respective contacting points, and wherein a line connecting the contacting points extends perpendicularly to a plate including the first point and second point of the cam plate and the axis of the drive shaft.

16. The compressor as set forth in claim 15, wherein said two contacting points are angularly displaced with respect to each other.

17. The compressor as set forth in claim 16, wherein each of said guide pins has a spherical end.

18. The compressor as set forth in claim 17, wherein said drive plate is a lug plate.

19. The compressor as set forth in claim 18, wherein said cam plate is a swash plate.

20. The compressor as set forth in claim 16, wherein one of said guide holes has a laterally elongated shape in the direction of rotation of said cam plate, providing a linear portion close to the drive plate, the guide pin in said guide hole being in engagement with said linear portion of the guide hole.

21. The compressor as set forth in claim 16, wherein the second guide hole has a circular shape, said second guide pin being in engagement with said second guide hole at a location along said circular shape.

22. A compressor comprising:

a housing having a cylinder bore;

a drive shaft supported by the housing;

a cam plate supported by the drive shaft;

a piston coupled to the cam plate to reciprocate in the cylinder bore to compress gas supplied from an external circuit and to discharge the compressed gas;

a drive plate supported on the drive shaft for integral rotation therewith, the drive plate having a surface facing the cam plate; and a hinge coupling the cam plate to the drive plate for causing the cam plate to integrally rotate with the drive shaft and to permit the cam plate to tilt with respect to the axis of the drive shaft, wherein the hinge has a first guide pin and a second guide pin formed on one of the cam plate and the drive plate;

wherein the hinge means has a first guide hole and a second guide hole formed in the other of the cam plate and the drive plate for receiving the first guide pin and the second guide pin, wherein the second guide pin engages the second guide hole at one contact point, and wherein the guide holes are arranged relative to the cam plate so that a line connecting the contact point between the second guide pin and the center of the first guide pin is perpendicular to a plate that includes a top dead center point of the cam plate, a bottom dead center point of the cam plate, and the axis of the drive shaft.

23. The compressor as set forth in claim 22, wherein the first and the second guide pins are fixed to the cam plate, and wherein the first and the second guide holes are formed in the drive plate.

24. The compressor as set forth in claim 22, wherein each guide pin includes a spherical portion.

25. The compressor as set forth in claim 22, wherein the first guide hole has a flat wall for receiving a compression reaction force from the first guide pin.

* * * * *

UNITED STATES PATENT AND TRADEMARK OFFICE

CERTIFICATE OF CORRECTION

PATENT NO. : 6,146,107
DATED : November 14, 2000
INVENTOR(S) : Masahiro Kawaguchi et al.

Figure 9:
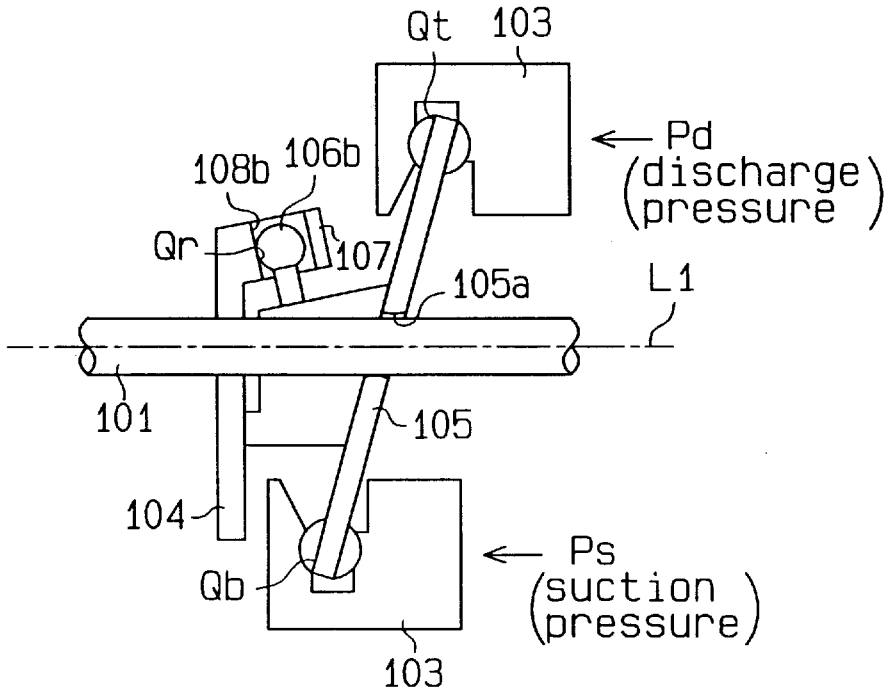
Fig.9(Prior Art)
FIG. 9 is a schematic view used to explain the application of compression reaction.

It is certified that error appears in the above-identified patent and that said Letters Patent is hereby corrected as shown below:

Title page,
Item [57], ABSTRACT,
Line 13, please delete “shalt” and insert therefor -- shaft --;

Column 1,
Line 13, please delete “FIG. 9a” and insert therefor -- FIG. 9, a --.
Line 49, please delete “Li” and insert therefor -- L1 --;

Column 2,
Line 63, “cam plate i.e.,” should read -- cam plate, i.e., --;

Column 4,
Lines 36-37, please delete “32 and the drive swash plate 32 guide the inclination of the shaft 26.” and insert therefor -- 32 and the drive shaft 26 guide the inclination of the swash plate 32. --.

Column 6,
Line 59, please start a new paragraph after “74.”;

Column 7,
Line 13, please delete “apin” and insert therefor -- pin --;
Line 14, please delete “3b” and insert therefor -- 33b --;
Line 17, please delete “than the nearmost portion] and insert therefor -- , i.e., farther from the lug plate surface 31b, than the corresponding portion 91, --;
Line 67, please delete “though” and insert therefore -- through --;

Column 9,
Line 26, please delete “it”;

Column 10,
Line 50, please delete “ah”;
Line 66, please delete “35a1.” and insert therefor -- 35a. --;

Column 11,
Line 21, please insert -- as compared with the corresponding nearest -- after “swash plate 32”;
Lines 64-65, please delete “drive shaft 36” and insert therefor -- drive shaft 26 --;

UNITED STATES PATENT AND TRADEMARK OFFICE

CERTIFICATE OF CORRECTION

PATENT NO. : 6,146 107
DATED : November 14, 2000
INVENTOR(S) : Masahiro Kawaguchi et al.

It is certified that error appears in the above-identified patent and that said Letters Patent is hereby corrected as shown below:

Column 12,
Line 15, please delete “106” and insert therefor -- 106b --;

Column 13,
Line 24, please insert -- d -- after “distance”.

Signed and Sealed this

Twenty-fourth Day of September, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,146,107
DATED : November 14, 2000
INVENTOR(S) : Masahiro Kawaguchi et al.

It is certified that error appears in the above-identified patent and that said Letters Patent is hereby corrected as shown below:

Title page,
Item [30], Foreign Application Priority Data, please delete "August 9, 1997" and insert therefor -- September 8, 1997 --.

Signed and Sealed this

Twenty-second Day of October, 2002

*Attest:*

*Attesting Officer*

JAMES E. ROGAN
*Director of the United States Patent and Trademark Office*